US006908590B2

(12) United States Patent
DasGupta

(10) Patent No.: US 6,908,590 B2
(45) Date of Patent: Jun. 21, 2005

(54) ALUMINUM ALLOY

(75) Inventor: Rathindra DasGupta, Portage, MI (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/100,053

(22) Filed: Mar. 19, 2002

(65) Prior Publication Data

US 2003/0178106 A1 Sep. 25, 2003

(51) Int. Cl.[7] ..... C22C 21/02

(52) U.S. Cl. ..... 420/534; 420/535; 420/536; 148/417

(58) Field of Search ..... 148/417, 439, 148/416, 438; 420/534, 535, 536, 537, 538

(56) References Cited

U.S. PATENT DOCUMENTS

| | | | | | |
|---|---|---|---|---|---|
| 4,808,374 | A | * | 2/1989 | Awano et al. | 420/537 |
| 4,973,363 | A | * | 11/1990 | Hayato et al. | 148/549 |
| 6,277,217 | B1 | | 8/2001 | Yoshino et al. | 148/440 |
| 6,306,342 | B2 | | 10/2001 | Koch et al. | 420/543 |
| 6,309,481 | B1 | | 10/2001 | Koch et al. | 148/440 |
| 6,331,218 | B1 | | 12/2001 | Inoue et al. | 148/561 |
| 6,334,911 | B2 | | 1/2002 | Kita et al. | 148/416 |
| 6,342,180 | B1 | | 1/2002 | Lefebvre et al. | 420/407 |

OTHER PUBLICATIONS

"Registration Record of Aluminum Association Alloy Designations and Chemical Composition Limits for Aluminum Alloys in the Form of Castings and Ingot", 1989, p 4.*
"Aluminum and Aluminum Alloys" ASM International, 1993, p 97.*
"Slurry–Based Semi–Solid Die Casting," Advanced Materials & Processes, Oct. 2001, pp. 49–51.
"Metalcasting and Molding Processes," Technical Articles, Dec. 2001, pp. 1–10.
"A Guide to Aluminum Casting Alloys," Technical Articles, Dec. 2001, pp. 1–8.
"Guide to Casting and Molding Processes," Technical Articles, Dec. 2001, pp. 1–16.
"Cost–Effective Casting Design: What Every Component Designer Should Know," Michael A. Gwyn, Pelton Casteel, Inc., pp. 1–29.
"Semi–Solid Metal (SSM) Engineered Components," Formcast, Overview, Dec. 2001, p. 1.
"Semi–Solid Metal (SSM) Engineered Components," Formcast, Chemical Compositions, Dec. 2001, p. 1.
"Semi–Solid Metal (SSM) Engineered Components," Formcast, Mechanical Properties, Dec. 2001, p. 1.
"The Semi–Solid Process," Hot Metal Molding, Inc., Dec. 2001, pp. 1–3.
"Relative Quality and Production costs of Formed Parts from Aluminum Alloys," Hot Metal Molding, Inc., Dec. 2001; pp. 1–2.
"SSM—The Process of Choice for Automotive," Hot Metal Molding, Inc., Dec. 2001, pp. 1–2.
"Alloy Development & Technologies," Hot Metal Molding, Inc., Dec. 2001, pp. 1–3.
"SSM Alloys," Hot Metal Molding, Inc., Dec. 2001, pp. 1–2.

* cited by examiner

*Primary Examiner*—George Wyszomierski
*Assistant Examiner*—Janelle Morillo
(74) *Attorney, Agent, or Firm*—Baker & Hostetler LLP

(57) ABSTRACT

All aluminum alloy is disclosed that includes 6.5 to 8.5 percent silicon, 0.6 to 1.0 percent iron, 0.0 to 0.5 percent manganese, 0.35 to 0.65 percent magnesium, 0.0 to 1.0 percent zinc, 0.0 to 0.2 percent titanium, 2.0 to 2.5 percent copper, and aluminum as the remainder with further one or more other elements that are 0.0 to 0.15 percent of the weight of the aluminum alloy. An aluminum alloy of the above composition is high in strength and suitable for use with SSM methods of casting, such as Rheocasting and Thixocasting.

4 Claims, 3 Drawing Sheets

ALUMINUM ALLOY

FIELD OF THE INVENTION

The present invention relates generally to casting alloys. More particularly, the present invention is directed to an aluminum alloy for semi-solid metal (SSM) casting processes.

BACKGROUND OF THE INVENTION

SSM aluminum alloy castings outperform, in both cost and performance, other casting techniques, such as conventional die casting, which is performed under high pressure, gravity permanent mold casting and squeeze casting. SSM casting methods, when utilized for the manufacturing of aluminum alloy products/castings, have proven advantageous over other casting techniques because SSM castings tend to exhibit higher mechanical properties in the areas of strength and ductility and reduced porosity than castings produced by the above-listed other methods.

Microstructures of SSM aluminum alloy castings reveal the primary phase particles as round crystals that are often referred to as rosettes or globules. The primary phase particles in SSM aluminum alloy castings that contain less than twelve percent silicon are comprised of essentially aluminum. Because solid primary phase particles are part of the semi-solid metal being injected into a mold/die cavity, the microstructure of the primary phase of an aluminum alloy prior to injection into a mold/die is indicative of the microstructure of the primary phase of the resulting aluminum alloy casting. Thus, when SSM methods of casting are utilized, the mechanical properties of a casting can be predicted before a casting is even produced. Accordingly, the production of castings with defects can be avoided.

Unlike SSM methods of casting, non-SSM casting processes involve injection/pouring of a molten metal directly into the die. Thus, because the metal is molten, with no parts of the metal being solid, the microstructure of the resulting casting cannot be ascertained until after the molten metal has solidified in the mold/die cavity. Thus, with non-SSM casting processes the microstructure of the primary phase of a casting cannot be predicted before the casting is formed.

Typically, the microstructures of castings prepared by non-SSM casting processes have dendrites. Dendrites are "tree-like " structures, and castings with dendrites are prone to microporosity and have inferior mechanical properties than those that exhibit round crystals.

Thixocasting and Rheocasting are SSM methods of casting. Thixocasting involves the electromagnetic stirring of metal during solidification/freezing to provide aluminum SSM feedstock billets up to approximately 4" in diameter. The stirring action due to the movement of liquid fragments the aluminum dendrites as they form during solidification and results in the formation of small equiaxed grains in the billets. The billets are subsequently cut into slugs, and re-heated to a semi-solid state before being injected into the cavity. It is during the billet re-heating stage that the equiaxed aluminum grains undergo globularization. Chemically grain-refined billets are often used in lieu of electromagnetically stirred billets. Heating of grain-refined billets in the semi-solid temperature regime also helps yield globular primary phase particles prior to injection into die cavity.

Rheocasting, which is also known as "slurry " or "slurry-on-demand " casting, involves heating a metal to a liquid state, cooling the molten metal to a semi-solid state, and then injecting the semi-solid metal into the die cavity. Rheocasting is more efficient than Thixocasting because Rheocasting involves fewer steps than Thixocasting.

Rheocasting has also proven to be more economically feasible than Thixocasting because any unused scrap metal can be easily re-melted and reprocessed by an SSM component manufacturer. With Thixocasting, the scrap metal has to be reformed into billets by the billet manufacturer via the use of electromagnetic stirring or chemical grain refining before being used again. However, unlike Thixocasting, Rheocasting requires only that the scrap metal is re-melted and cooled to a semi-solid state before it is injected into a die cavity. As a result, scrap metal can easily be reused with the Rheocasting method of SSM casting and the expense associated with recycling scrap metal is less.

In recent years, SSM casting methods utilizing aluminum alloys have been used for manufacturing brake cylinders, fuel rails, engine brackets steering knuckles, suspension links and auto seat backs because, in addition to the above-discussed advantages over non-SSM casting techniques, SSM casting methods offer non-turbulent filling (i.e., less air entrapment), require lower die temperatures, reduce cycle time, reduce shrinkage, and provide the option of heat treatment (i.e., solution treatment).

Among the various casting alloys in use, A356.2 and 357 are the primary aluminum alloys used for SSM castings, including castings of automotive components. The chemistries of A356.2 and 357 are as follows:

| A356.2 | | 357 | |
|---|---|---|---|
| Element | Percent of Weight | Element | Percent of Weight |
| Silicon | 6.5–7.5 | Silicon | 6.5–7.5 |
| Iron | 0.12 max | Iron | 0.12 max |
| Manganese | 0.05 max | Manganese | 0.03 max |
| Magnesium | 0.30–0.45 | Magnesium | 0.45–0.6 |
| Zinc | 0.50 max | Zinc | 0.05 max |
| Titanium | 0.20 max | Titanium | 0.20 max |
| Copper | 0.10 max | Copper | 0.03 max |
| Others | 0.15 total | Others | 0.15 total |
| Aluminum | Balance | Aluminum | Balance |

A356.2 and 357, when used with SSM casting methods, generate castings of essentially high toughness, i.e., ability to absorb energy before failure, and thus, have been found suitable for automotive components, such as steering knuckles and suspension links.

However, the A356.2 and 357 alloys, when used with SSM casting methods, have not been found suitable for automotive components that require essentially high strength, i.e., high load bearing ability, such as axle carriers, rack and pinion housings, and steering column housings.

There are, however, problems associated with the use of A356.2 and 357 aluminum alloys. Maintaining low percentages of iron, copper and zinc increases the cost of the A356.2 and 357 aluminum alloys. By keeping the iron content low, there is also the potential that soldering will occur during the casting process. Soldering refers to the phenomenon that takes place when aluminum adheres to the die cavity during the die casting process. Soldering occurrences often lead to defective castings.

Accordingly, it is desirable to provide an aluminum alloy that can be utilized with SSM methods of castings, especially with the increasingly popular Rheocasting method of SSM casting, that can produce high integrity, high-strength automotive components, such as axle carriers, rack and pinion housings, and steering column housings.

Further, it is desirable to provide an aluminum alloy that is less prone to the soldering phenomenon.

It is also desirable to provide an alloy that is less expensive to produce than other alloys such as A 356.2 and 357.

SUMMARY OF THE INVENTION

In an exemplary embodiment of the present invention, an alloy in accordance with the present invention is provided that includes 6.5 to 8.5 percent silicon, 0.60 to 1.0 percent iron, 0.0 to 0.5 percent manganese, 0.35 to 0.65 percent magnesium, 0.0 to 1.0 percent of zinc, 0.0 to 0.2 percent titanium, 2.0 to 2.5 percent copper, and aluminum as the remainder with further one or more other elements 0.0 to 0.15 percent of the weight.

In another exemplary embodiment of the present invention a die cast product is provided that includes 6.5 to 8.5 percent silicon, 0.60 to 1.0 percent iron, 0.0 to 0.5 percent manganese, 0.35 to 0.65 percent magnesium, 0.0 to 1.0 percent of zinc, 0.0 to 0.2 percent titanium, 2.0 to 2.5 percent copper, and aluminum as the remainder with further one or more other elements 0.0 to 0.15 percent of the weight.

In yet another exemplary embodiment of the present invention a method of making a die cast product is provided that includes forming a semi-solid aluminum alloy, wherein the semi-solid aluminum alloy contains 6.5 to 8.5 percent silicon, 0.60 to 1.0 percent iron, 0.0 to 0.5 percent manganese, 0.35 to 0.65 percent magnesium, 0.0 to 1.0 percent of zinc, 0.0 to 0.2 percent titanium, 2.0 to 2.5 percent copper, and aluminum as the remainder with further one or more other elements 0.0 to 0.15 percent of the weight, and placing the semi-solid aluminum alloy in a die cavity.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENTS OF THE INVENTION

An aluminum alloy in accordance with the present invention is a high copper, manganese and iron (HiCMF) aluminum alloy. In an exemplary embodiment of the present invention, an aluminum alloy in accordance with the present invention, is composed of the below-listed elements, by percentage of weight, as follows:

| Element | % of Weight |
|---|---|
| Silicon | 6.5 to 8.5 |
| Iron | 0.6 to 1.0 |
| Manganese | 0 to 0.5 |
| Magnesium | 0.35 to 0.65 |
| Zinc | 0–1.0 |
| Titanium | 0–0.2 |
| Copper | 2.0–2.5 |
| Tin | 0–0.3 |
| Others | 0–0.15 |
| Aluminum | Balance |

In a preferred embodiment of the present invention, the "others" are lead and/or chromium.

An aluminum alloy in accordance with the present invention is suitable for SSM methods of casting because the microstructure of the primary aluminum phase of the metal slurry prior to its injection into a die cavity is comprised of globular and/or rosette crystals.

An alloy in accordance with the present invention is hypoeutectic because its silicon content is less than 12 percent. The primary phase metal of an alloy in accordance with the present invention is aluminum.

Alloys with silicon composing less than twelve percent of their weight are hypoeutectic and alloys with silicon composing more than twelve percent of their weight are hypereutectic.

Figure 1:
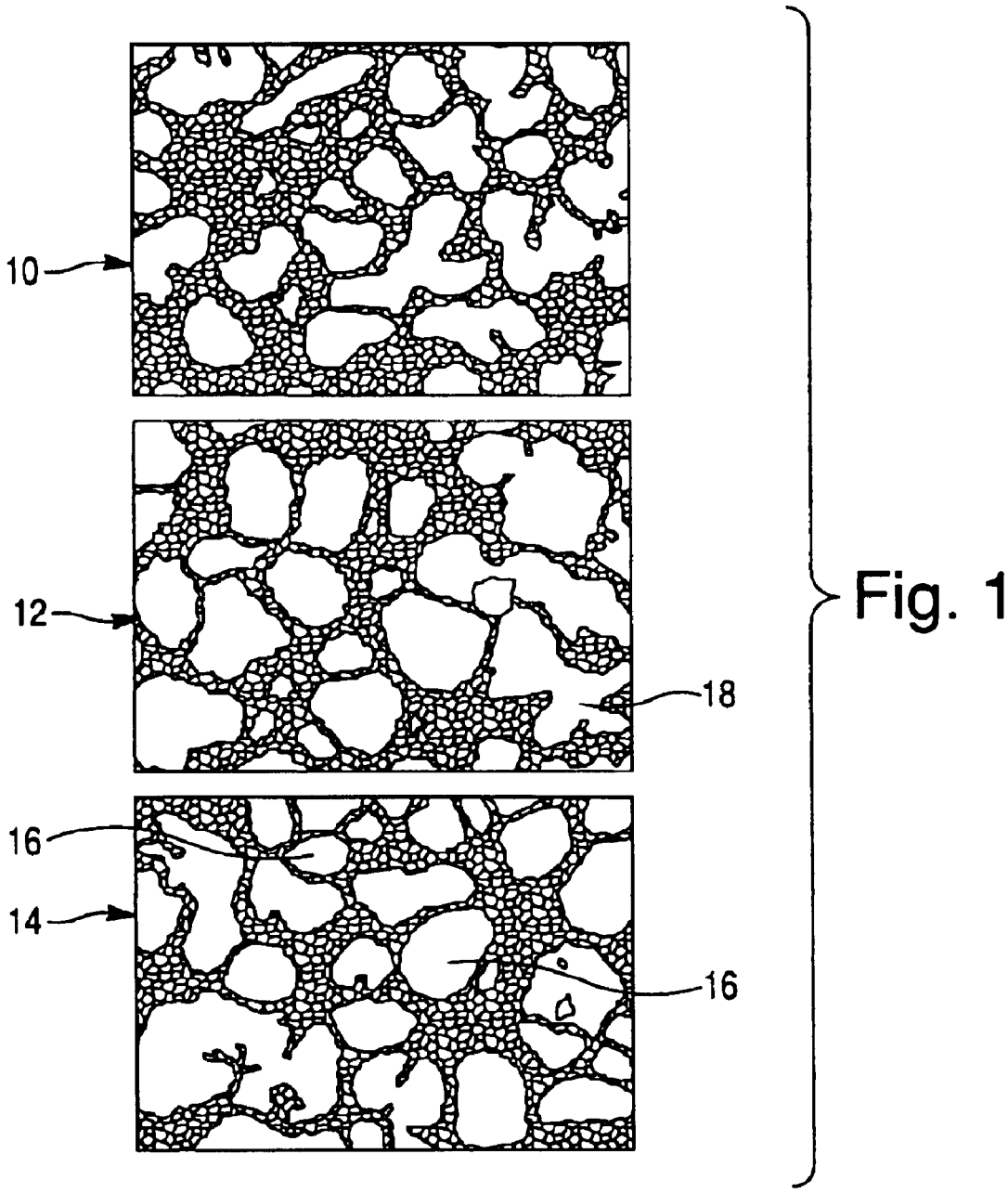
FIG. 1 illustrates microstructures of an exemplary embodiment an aluminum alloy in accordance with the present invention.
Figure 2:
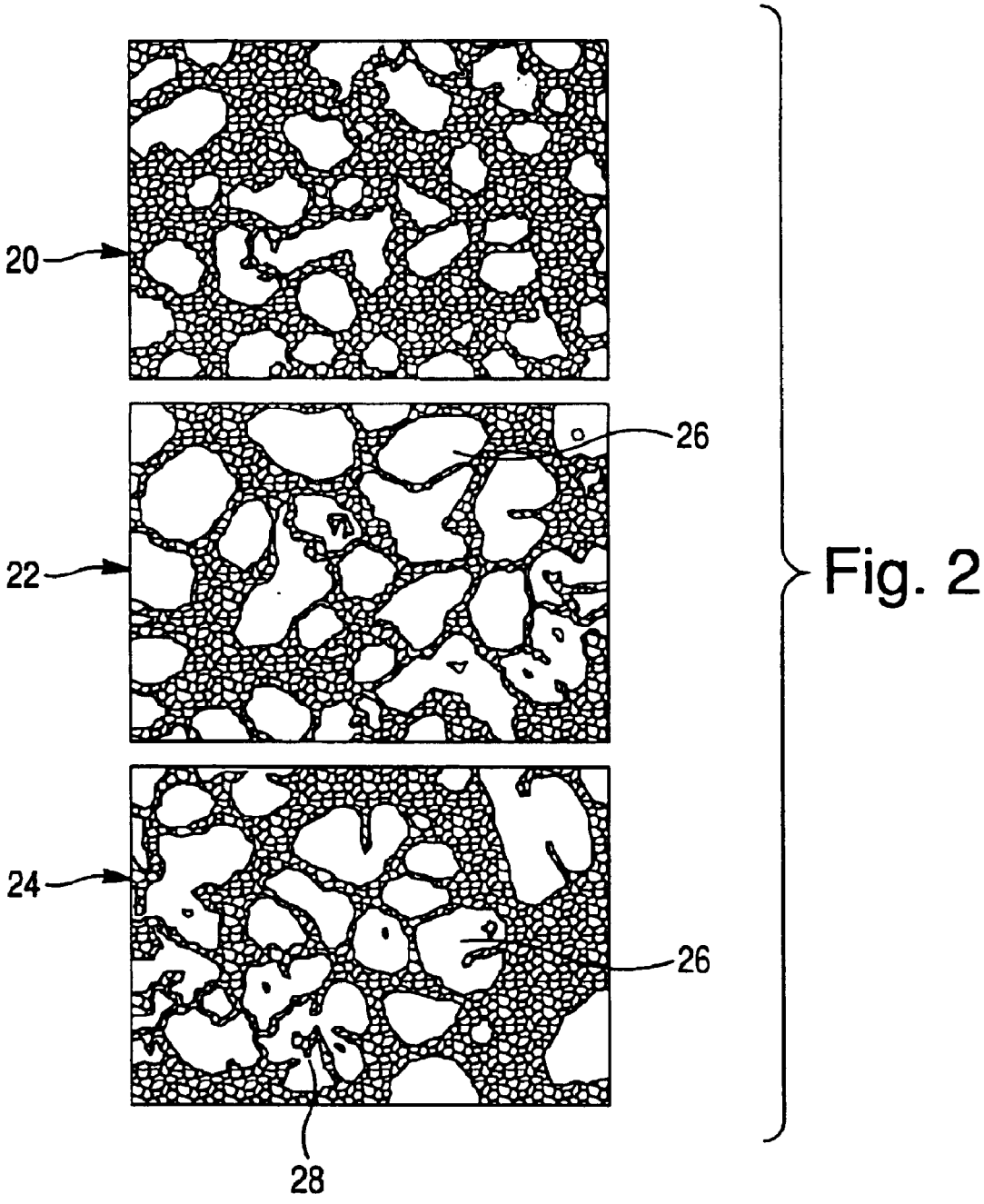
FIG. 2 illustrates microstructures of an exemplary embodiment of an aluminum alloy in accordance with the present invention.

Referring to FIG. 1 and FIG. 2, shown are microstructures of the primary phase from various locations of an aluminum alloy in accordance with the present invention prior to its injection into a die cavity. The illustrations of FIG. 1 and FIG. 2 were ascertained in accordance with the conventional evaluation method of "water-quenching," which "locks in" the microstructure. The microstructures of FIG. 1, from top to bottom, are from the middle edge 10, middle 12 and center 14 of a water-quenched slug. It can be seen from FIG. 1 that the primary aluminum phase particles consist of round crystal/globular 16, and/or rosette 18 formations.

FIG. 2 depicts microstructures of the primary phase of an aluminum alloy in accordance with the present invention prior to its injection into a die cavity. The microstructures of FIG. 2, from top to bottom, are from the bottom edge 20, middle 22 and center 24 of a water-quenched slug. It can be seen from FIG. 2 that the primary aluminum phase particles of an aluminum alloy in accordance with the present invention consist of round crystal/globular 26 and/or rosette 28 formations.

Figure 3:
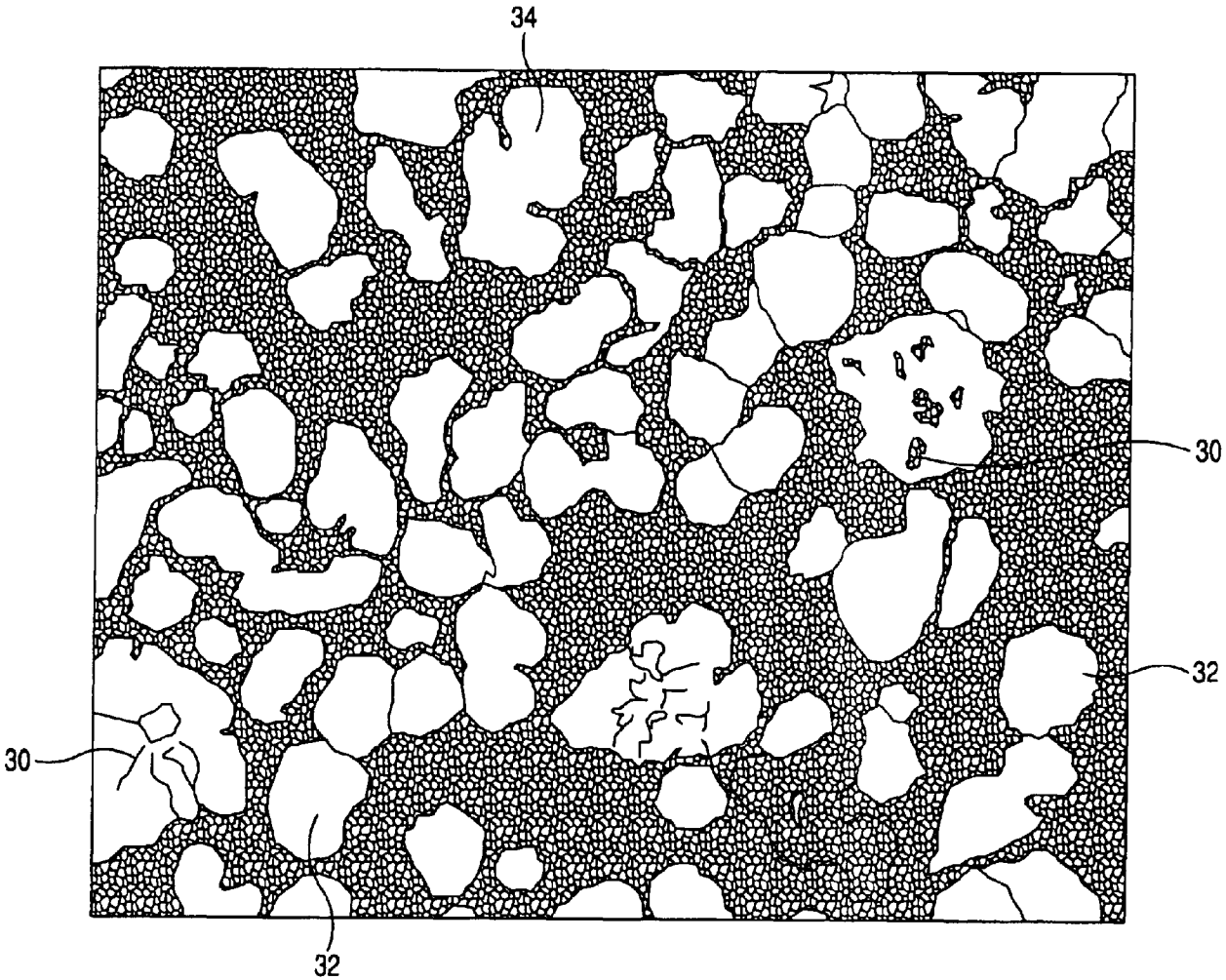
FIG. 3 illustrates microstructures of an exemplary embodiment of an aluminum alloy in accordance with the present invention.

FIG. 3 depicts microstructures of the primary phase of an aluminum alloy in accordance with the present invention after it has been injected into a die cavity. It can be seen from FIG. 3 that the primary aluminum phase particles of an aluminum alloy in accordance with the present invention consist of round crystals/globular 32 and/or rosette 34 formations. Thus, when FIG. 1 and FIG. 2 are compared with FIG. 3, it can be seen that the morphology of the primary aluminum phase prior to injection into a die cavity is similar to that of the aluminum alloy in the resulting casting. Accordingly, the microstructure of the primary phase of an alloy in accordance with the present invention can be determined before it is utilized to form a casting. Thus, the number of casts with microstructures unsuitable for their purpose can be reduced.

In an exemplary embodiment of the present invention silicon is restricted to 7.2 percent to 8 percent of the weight to efficiently achieve formation of the primary aluminum phase during the cooling of the molten metal to the semi-solid state.

Additionally, the amount of silicon present in an aluminum alloy may be directly related to the strength of the aluminum alloy. Typically, the higher the content of silicon, the higher the strength of the aluminum alloy. In exemplary embodiments of the present invention, the average silicon content of the alloy is higher than other alloys, such as the A356.2 and 357 aluminum alloys. Accordingly, the strength of an aluminum alloy in accordance with the present invention is higher than other alloys, such as A 3562.2 and 357.

Further, as shown in FIG. 3, an aluminum alloy in accordance with the present invention reveals the presence of fine aluminum-silicon eutectic and entrapped intermetallic particles 30 within the round crystals, globular and/or rosette primary aluminum phase. The entrapped intermetallic particles 30 essentially consist of iron, silicon and manganese.

Typically, the formation of the intermetallic particles 30, such as those shown in FIG. 3, lead to fractures that travel along a path (fracture path) within the structure of the casting. However, because the intermetallic particles 30 are entrapped within the round crystal/globular 32 and/or rosette 34 structures, the fracture path is now restricted. Accordingly, fractures occur with less frequency, especially when an aluminum alloy in accordance with the present invention is compared to the A356.2 and 357 aluminum alloys that do not reveal entrapped particles in their microstructures in the primary aluminum phase.

The formation of the intermetallic particles in an aluminum alloy in accordance with the present invention can be attributed to the high content of iron in the aluminum alloy. In an exemplary embodiment of the present invention, iron is 0.6 to 1.0 percent of the weight. In another exemplary embodiment of the present invention iron is 0.6 to 0.8 percent of the weight. The iron content of an aluminum alloy in accordance with the present invention is higher than other alloys, such as A 356.2 and 357 which are, at a maximum, 0.12 percent of the weight. Accordingly, an alloy in accordance with the present invention is less expensive than A 356.2 and 357 because the iron content does not have to be maintained low. Additionally, because the iron content is not low, the potential of soldering is reduced.

In an exemplary embodiment of the present invention, magnesium is approximately 0.35 to 0.65 percent of the weight. The magnesium content of an aluminum alloy in accordance with the present invention is higher than the magnesium content of other aluminum alloys, such as the A 356.2 and 357, which is 0.30 to 0.45 and 0.45 to 0.6 percent of the weight, respectively. The strength of a casting made from an aluminum alloy in accordance with the present invention will be even greater after the alloy has been heat treated, i.e., subjected to a solution treatment and artificially aged. In a preferred embodiment of an aluminum alloy in accordance with the present invention, the magnesium content is approximately 0.45 to 0.6 percent of the weight.

As a result of its high strength, an aluminum alloy in accordance with the present invention is suitable for the manufacturing of products that require high strength, such as axle carriers, rack and pinion housings and steering column housings by both Rheocasting and Thixocasting.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to as falling within the scope of the invention.

What is claimed is:

1. An aluminum alloy, consisting essentially of the following constituents by percentage of weight:

| | |
|---|---|
| 6.5 to 8.5 | percent silicon; |
| 0.6 to 1.0 | percent iron; |
| 0.0 to 0.5 | percent manganese; |
| 0.35 to 0.65 | percent magnesium; |
| 0.0 to 1.0 | percent zinc; |
| 0.0 to 0.2 | percent titanium; |
| 2.0 to 2.5 | percent copper; |
| 0.15 | percent one or more other elements; and aluminum as the remainder, wherein the one or more other elements is lead. |

2. An aluminum alloy, consisting essentially of the following constituents by percentage of weight:

| | |
|---|---|
| 6.5 to 8.5 | percent silicon; |
| 0.6 to 1.0 | percent iron; |
| 0.0 to 0.5 | percent manganese; |
| 0.35 to 0.65 | percent magnesium; |
| 0.0 to 1.0 | percent zinc; |
| 0.0 to 0.2 | percent titanium; |
| 2.0 to 2.5 | percent copper; |
| 0.15 | percent one or more other elements; and aluminum as the remainder, wherein the one or more other elements are lead and chromium. |

3. A die cast product, comprising by percentage of weight:

| | |
|---|---|
| 6.5 to 8.5 | percent silicon; |
| 0.6 to 1.0 | percent iron; |
| 0.0 to 0.5 | percent manganese; |
| 0.35 to 0.65 | percent magnesium; |
| 0.0 to 1.0 | percent zinc; |
| 0.0 to 0.2 | percent titanium; |
| 2.0 to 2.5 | percent copper; |
| 0.15 | percent one or more other elements; and aluminum as the remainder, wherein the one or more other elements is lead. |

4. A die cast product, comprising by percentage of weight:

6.5 to 8.5 percent silicon;

0.6 to 1.0 percent iron;

0.0 to 0.5 percent manganese;

0.35 to 0.65 percent magnesium;

0.0 to 1.0 percent zinc;

0.0 to 0.2 percent titanium;

2.0 to 2.5 percent copper;

0.15 percent one or more other elements; and aluminum as the remainder, wherein the one or more other elements are lead and chromium.

* * * * *